US012024324B2

(12) United States Patent
Hoffman

(10) Patent No.: US 12,024,324 B2
(45) Date of Patent: Jul. 2, 2024

(54) BEVERAGE PACKAGING APPARATUS

(71) Applicant: Scott Hoffman, Gainesville, VA (US)

(72) Inventor: Scott Hoffman, Gainesville, VA (US)

( * ) Notice: Subject to any disclaimer, the term of this patent is extended or adjusted under 35 U.S.C. 154(b) by 303 days.

(21) Appl. No.: 17/462,749

(22) Filed: Aug. 31, 2021

(65) Prior Publication Data

US 2022/0144461 A1 May 12, 2022

Related U.S. Application Data

(60) Provisional application No. 63/112,697, filed on Nov. 12, 2020.

(51) Int. Cl.

| | |
|---|---|
| ***B65B 3/30*** | (2006.01) |
| ***B65B 7/28*** | (2006.01) |
| ***B65B 31/04*** | (2006.01) |
| ***B65B 39/00*** | (2006.01) |
| ***B65B 43/42*** | (2006.01) |

(Continued)

(52) U.S. Cl.

CPC ..... *B65B 3/30* (2013.01); *B65B 7/2842* (2013.01); *B65B 31/04* (2013.01); *B65B 39/00* (2013.01); *B65B 43/42* (2013.01); *B65B 55/08* (2013.01); *B65B 57/02* (2013.01); *B65B 63/08* (2013.01); *B65B 2039/009* (2013.01)

(58) Field of Classification Search

None

See application file for complete search history.

(56) References Cited

U.S. PATENT DOCUMENTS 3,233,386 A * 2/1966 Burke ..... B65B 7/2885 53/329.2
5,054,265 A * 10/1991 Perigo ..... B21D 51/32 53/425

(Continued)

FOREIGN PATENT DOCUMENTS

EP 1120121 A2 * 8/2001 ..... A61L 2/10
FR 2515609 A1 * 5/1983 ..... B65B 69/0025

(Continued)

*Primary Examiner* — Tanzim Imam

(74) *Attorney, Agent, or Firm* — Merchant & Gould P.C.

(57) ABSTRACT

A beverage packaging apparatus comprises a Refrigeration Assembly that keeps the beverage cold all the way to the fill head. The Refrigeration Assembly also allows manufacturers to fill off smaller beverage containers like kegs or larger storage tanks. The apparatus includes an integrated Container Loading Chute, and a Container Depalletizer having a scoop to depalletize containers. The Container Depalletizer integrates with the Container Loading Chute to provide for seamless flow for the Fill Head Assemblies and Seaming Assembly. The apparatus includes a unique integrated UV-C Sanitizing Station. The apparatus includes a conveyor with three fill head assemblies automated by smooth pneumatic actuation. Each fill head assembly has an integrated flow meter to provide precise fluid control. The apparatus includes a single pneumatic, rotary rack and pinion actuation that provides highly repeatable sealing of the container in a very small footprint without requiring sophisticated software to control the seaming operation. Finally, the apparatus includes rinse and dry assembly for the container and an innovative, integrated Accumulation Assembly to hold the completed beverage containers or packages.

10 Claims, 6 Drawing Sheets

(51) Int. Cl.

| | |
|---|---|
| ***B65B 55/08*** | (2006.01) |
| ***B65B 57/02*** | (2006.01) |
| ***B65B 63/08*** | (2006.01) |

(56) References Cited

U.S. PATENT DOCUMENTS

| | | | | | |
|---|---|---|---|---|---|
| 5,149,239 | A * | 9/1992 | Honma | B21D 51/32 | 53/340 |
| 5,157,898 | A * | 10/1992 | Zanini | B67C 7/004 | 53/367 |
| 5,230,203 | A * | 7/1993 | Wu | B67C 7/00 | 53/503 |
| 10,195,657 | B1 | 2/2019 | Head et al. | | |
| 10,464,796 | B2 | 11/2019 | Jones et al. | | |
| 2004/0197164 | A1* | 10/2004 | Carrein | B21D 43/14 | 413/41 |
| 2015/0113921 | A1* | 4/2015 | Billings | G06Q 10/087 | 53/467 |
| 2019/0300213 | A1* | 10/2019 | Reiner | B65B 7/2857 | |

FOREIGN PATENT DOCUMENTS

| | | | | |
|---|---|---|---|---|
| FR | 2705658 | A1 * | 12/1994 | B65B 3/006 |
| JP | H10218249 | A * | 8/1998 | B65B 31/003 |

* cited by examiner

BEVERAGE PACKAGING APPARATUS

BACKGROUND OF THE INVENTION

The present invention relates to the field of beverage manufacturing and packaging of the manufactured product. Small beverage manufacturers require a means to package, sell and distribute products in small containers like cans and bottles. Carbonated beverages require the fluid to be cold for the CO2 to stay in suspension. Currently the market does not offer a packaging (canning, bottling, etc.) solution to do this that has built in refrigeration. All available solutions require an external refrigeration system in order to effectively fill a container. Small beverage manufacturers also produce different products in much lower volumes than the larger manufacturers. There is currently limited availability of fully automated fill and seaming apparatus that efficiently fill products in low volumes. Additionally, the available packaging apparatuses are expensive and unaffordable for many small beverage manufacturers. Small beverage manufacturers are in dire need of an affordable, fully capable container filling, and sealing apparatus. Finally, the apparatuses that are available in the market do not give direct feedback on how much volume of beverage is in each container. These available apparatuses require an external, post packaging step to verify the volume of beverage by weighing the package. A low cost, fully functional, refrigerated beverage fill and seal apparatus that provides direct inline volume control for each package is needed in the market.

BRIEF SUMMARY OF THE INVENTION

A beverage manufacturing apparatus is provided which may be configured to refrigerate carbonated beverages and to fill and seal beverage containers In some embodiments, the apparatus comprises a refrigeration unit that keeps the beverage cold all the way to the fill head. This refrigeration unit also allows manufacturers to fill off of smaller beverage containers like kegs or larger storage tanks. In further embodiments, the apparatus includes an integrated container delivery chute, and a container scoop to depalletize containers. The container scoop may integrate with the delivery chute to provide for seamless process flow for the filling and seaming apparatus. In further embodiments, the apparatus includes a unique integrated UV-C sanitizing station. In further embodiments, the apparatus includes a conveyor with preferably three fill heads that may be automated by smooth pneumatic actuation. Each fill head may have an integrated flow meter to provide precise fluid control. In further embodiments, the apparatus includes a single pneumatic, rotary rack and pinion actuation that provides highly repeatable sealing of the container in a very small footprint without requiring sophisticated software to control the seaming operation. In still further embodiments, the apparatus includes rinse and dry station for the container and an innovative, integrated accumulation table to hold the completed package.

In preferred embodiments, a beverage manufacturing apparatus that refrigerates a carbonated beverage, fills, and seals a container, may include: an integrated refrigeration Assembly that holds bulk beverage containers and includes an attachment to an external beverage storage tank, therefore allowing the beverage to stay cold which keeps the CO2 in suspension in the beverage; an Empty Container Loading Assembly for unloading empty containers from a pallet, by a single person, and loading said containers into the apparatus; an integrated Container Loading Chute which delivers empty containers to the sanitization station; an integrated Sanitization Station that uses UV-C light to sanitize the container prior to fill; an integrated Conveyor Assembly driven by an DC motor providing low voltage control and automation; an integrated three container, pneumatic Fill Head Assembly with separate CO2 and fluid fill tubes, and precise volumetric control via an integrated flow meter; an integrated control system with simple push button operation for full automated control without a need for an external software GUI interface; an integrated Container Lid Applicator Apparatus; an integrated Container Seaming Apparatus that uses a single pneumatic rotary actuator, which provides a highly repeatable, reliable double seam sealing operation; an integrated Container Rinse and Dry Assembly; and an integrated filled beverage Container Accumulation Assembly.

BRIEF DESCRIPTION OF THE DRAWINGS

Some embodiments of the present invention are illustrated as an example and are not limited by the figures of the accompanying drawings, in which like references may indicate similar elements and in which.

DESCRIPTION OF THE REFERENCED NUMERALS

Base Tray Assembly 1
Empty Container Loading Assembly 2
Integrated Container Depalletizer 2A
Container Loading Chute 2B
Fill Head Assembly 3
Flow Meter 3A
Solenoid 3B
Carbon Dioxide Purge Tube 3C
Beverage Fill Tube 3D
Pneumatic Actuator 3E
Seaming Assembly 4
Pneumatic Rotary Actuator 4B
Seaming Roll Interface Plate 4C
Seaming Chuck 4D
First Operation Seaming Roll 4E
Seaming Chuck 4F
Second Operation Seaming Roll 4F Lid Applicator Apparatus 5
Lids 5A
Lid Applicator Apparatus 5B
Container Accumulation Assembly 6
Container Rinse and Dry Assembly 7
Refrigeration Assembly 8
Conveyor Assembly 9
Control Assembly 10
Sanitization Station 11

DETAILED DESCRIPTION OF THE INVENTION

The various embodiments of the invention are described more fully hereinafter with reference to the accompanying drawings, in which some, but not all embodiments of the invention are shown in the figures. The inventions may be embodied in many different forms and should not be construed as limited to the embodiments set forth herein; rather, these embodiments are provided so that this disclosure will satisfy applicable legal requirements.

Unless otherwise defined, all terms including technical and scientific terms used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly defined herein.

In describing the invention, it will be understood that several techniques and steps are disclosed. Each of these has individual benefits and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
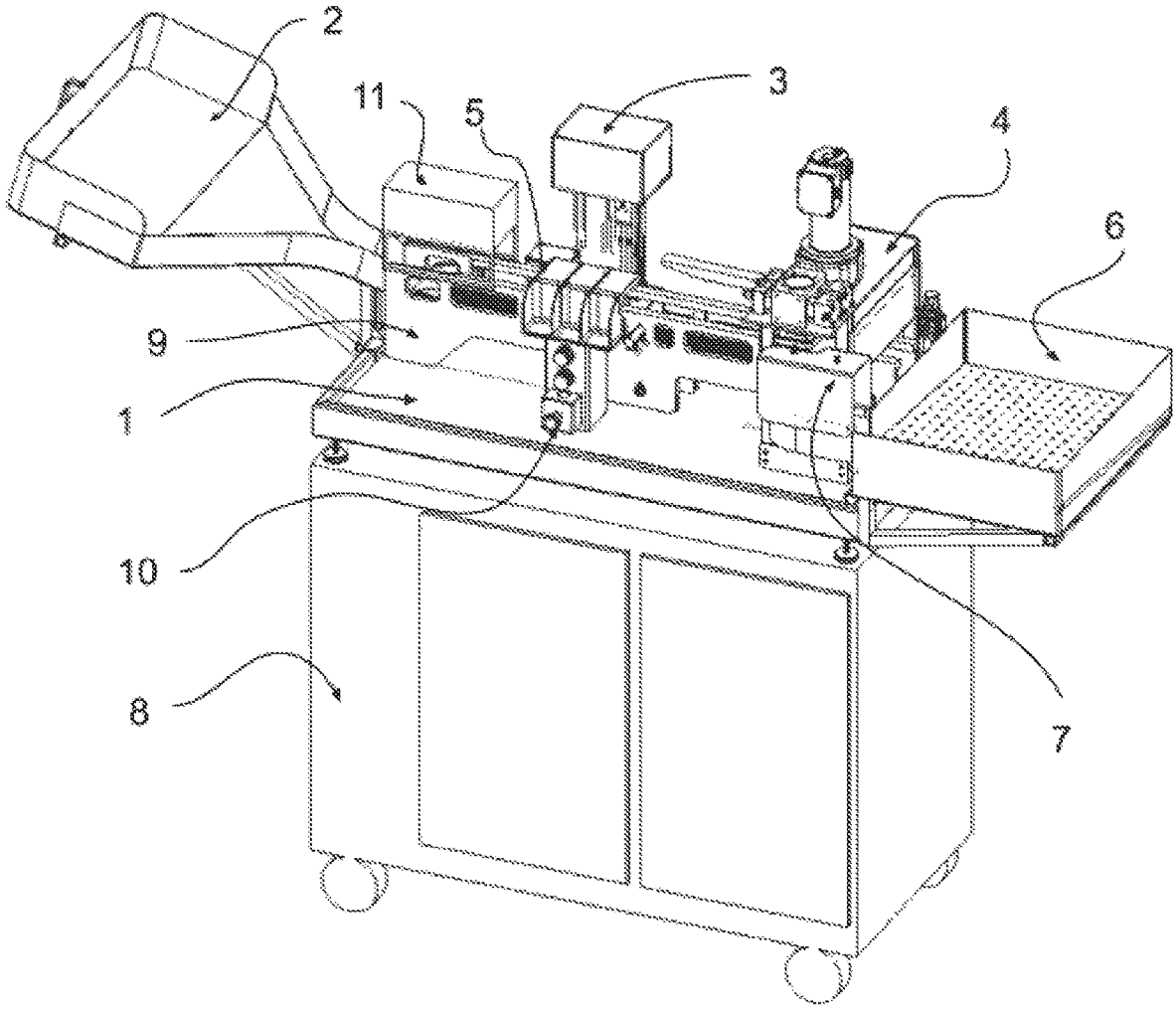
FIG. 1 shows an isometric illustration of an example of a beverage packaging apparatus according to various embodiments described herein.

FIG. 1 illustrates an example embodiment of a Beverage Packaging apparatus ("the apparatus") which may be configured to Refrigerate a Carbonated Beverage, and to Fill and Seal a Beverage Container. In some embodiments, the apparatus may include 11 different, subassembly items referenced in FIG. 1 and further explained in FIGS. 2-6. The subassemblies that are included in the embodiment shown in FIG. 1 and are preferably arranged with the Base Tray Assembly 1 which sets on top of the Refrigeration Assembly 8. Connected to the Base Tray Assembly 1 is the Conveyor Assembly 9, Empty Container Loading Assembly 2, Fill Head Assembly 3, Seaming Assembly 4, Lid Applicator Apparatus 5, Container Accumulation Assembly 6, Container Rinse and Dry Assembly 7, Control Assembly 10, and the Sanitization Station 11. The following paragraphs will further define a number of these subassemblies in greater detail and will define the process associated with refrigerating a beverage, filling a container with said beverage and seaming the container with a hermetic seal.

Filling beverage containers with carbonated fluids requires that the beverage be cold (below 38F) in order for the carbonation to stay in suspension of the beverage. Existing filling and seaming apparatus available in the market do not have an integrated refrigeration unit. Existing filling and seaming apparatus available in the market require the manufacturer to have an external means to cool the beverage like a refrigerated storage tank. On these types of systems, the beverage is transferred by uninsulated hoses from the storage tank to the filling and seaming apparatus. During transfer of the beverage, heat transfer from the warm hoses warms up the beverage, this causes the carbon dioxide to come out of suspension causing "break-out" or foaming at the fill head of the apparatus. This causes waste and leads to the possibility of a container not being filled to the correct volume due to excess foam in the container instead of the beverage fluid. Existing filling and seaming apparatus manufacturers will counter the heat transfer effect by cooling the beverage to almost freezing temperatures so that by the time the beverage reaches the fill head it will be at least 38F. This helps but manufacturers will constantly be adjusting the temperature as the transfer hoses get colder over time, due to the cold beverage running through the hoses.

The apparatus of the present invention solves this industry wide problem by providing integrated refrigeration with the Fill Head Assembly 3 and Seaming Assembly 4 shown in FIG. 1 by the Refrigeration Assembly 8. In this manner, the apparatus allows the beverage to stay cold all the way to the Fill Head Assembly 3, which alleviates any "break-out" or foaming concerns. Additionally, the integrated Refrigeration Assembly 8 also allows for other advantages like filling beverages from small storage containers that do not have built-in refrigerated cooling like kegs. The Refrigeration Assembly 8 will work with smaller, common industry storage containers (e.g. ½ bbl kegs or smaller) or additionally the Refrigeration Assembly 8 can also connect to an external refrigerated storage container via a hose as was mentioned previously, however the hose will pass through the Refrigeration Assembly 8 prior to be going to the Fill Head Assembly 3 in order to guarantee that the hose and beverage will stay cold and the carbon dioxide will stay in the beverage suspension.

Figure 2:
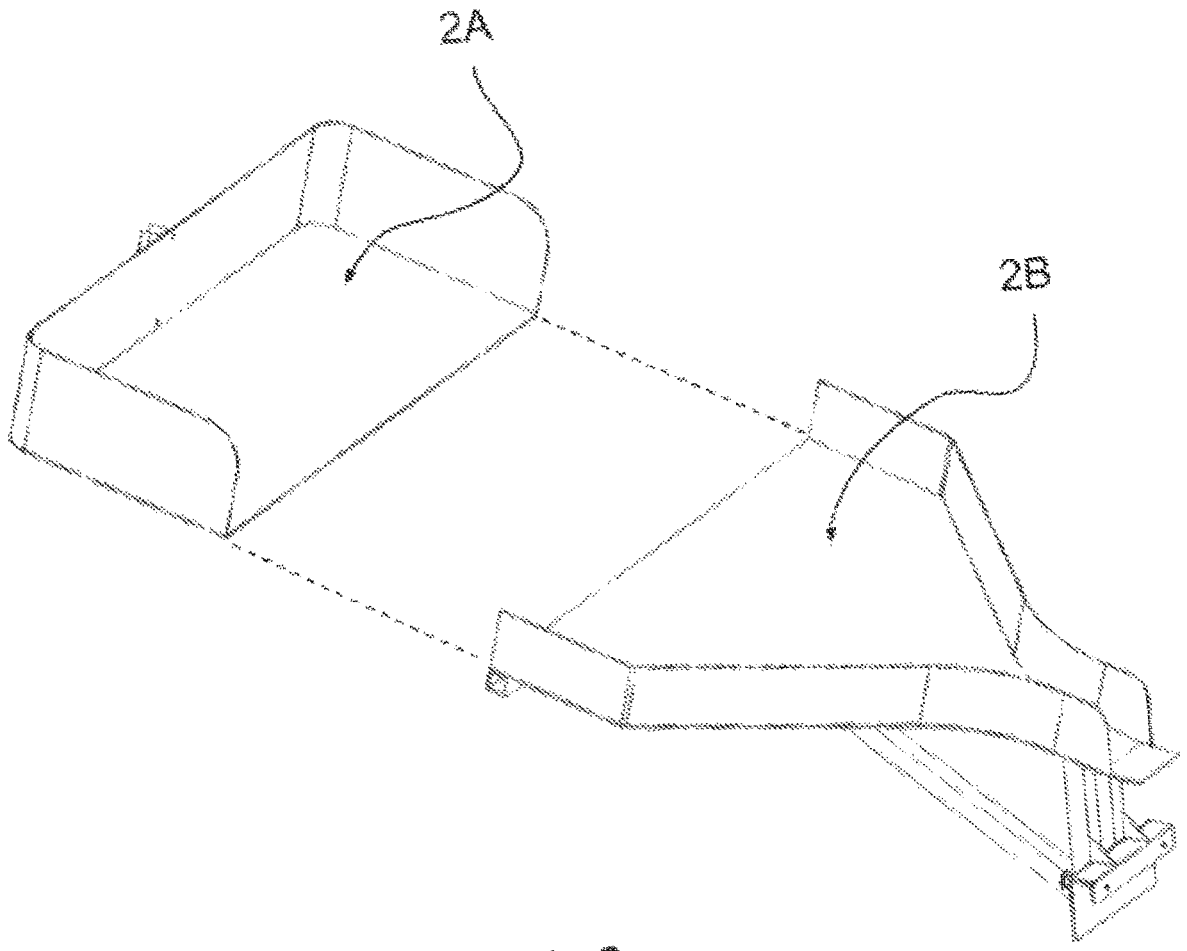
FIG. 2 illustrates an example of an Empty Container Loading Assembly which may include a Container Loading Chute 2B and an integrated Container Depalletizer 2A according to various embodiments described herein.
Figure 3:
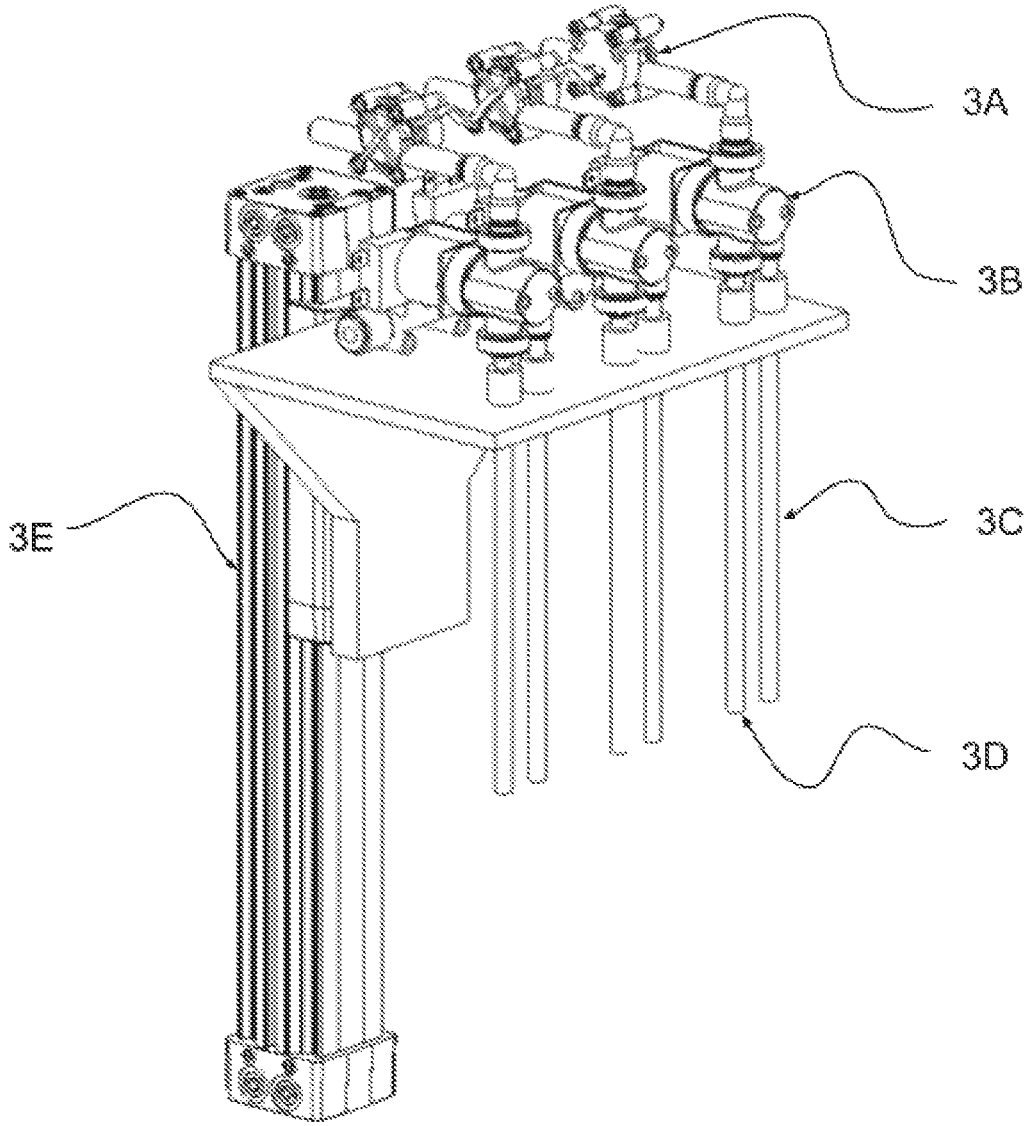
FIG. 3 illustrates an example of a Fill Head assembly which may include the following components: flowmeter 3A, solenoid 3B, carbon dioxide purge tube 3C, beverage fill tube 3D, and pneumatic actuator 3E according to various embodiments described herein.
Figure 4:
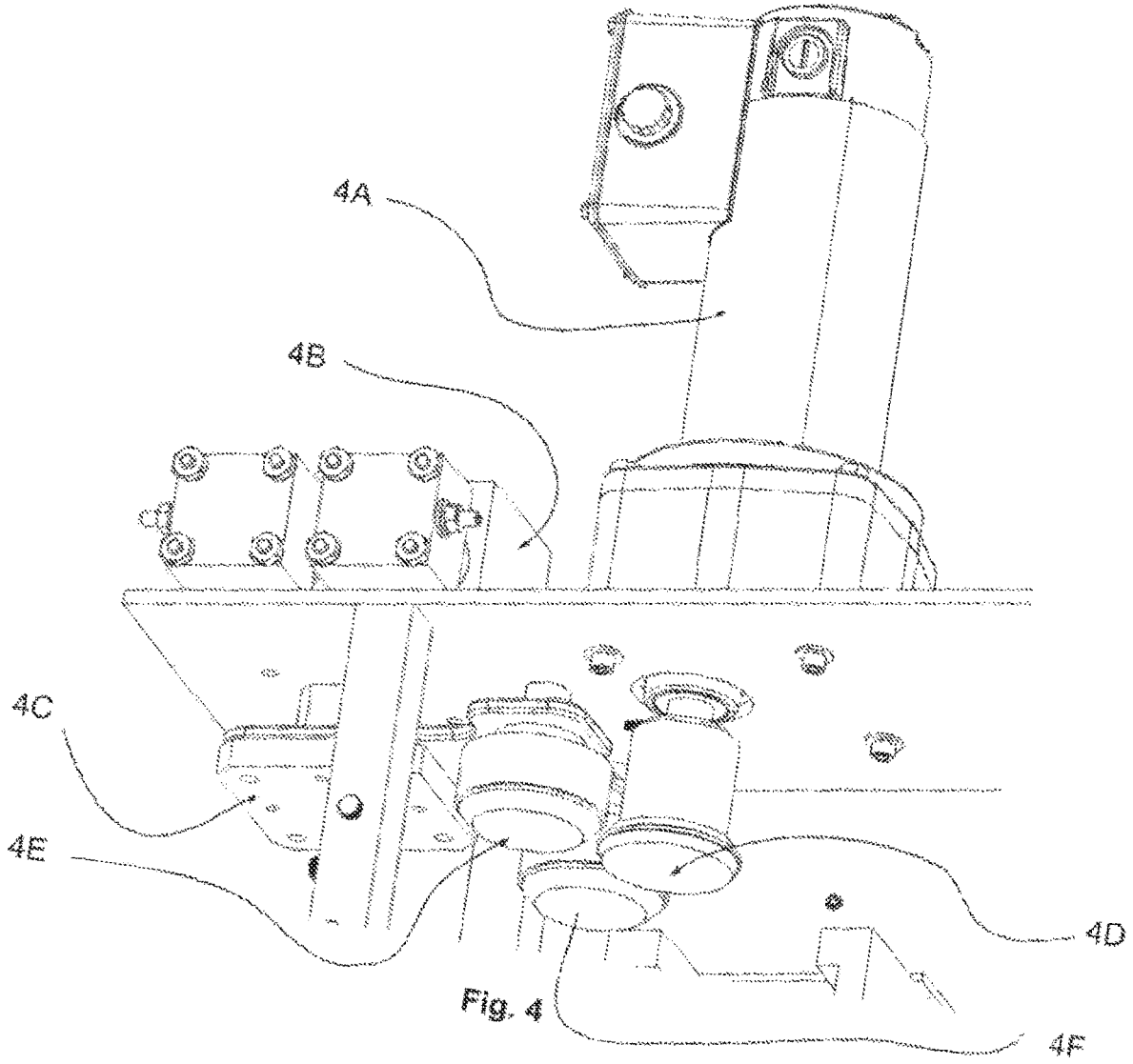
FIG. 4 illustrates an example of a Seaming Assembly which may include a DC motor 4A; pneumatic, 3-way, rack and pinion, rotary actuator 4B; and a seam roller interface plate 4C according to various embodiments described herein.
Figure 5:
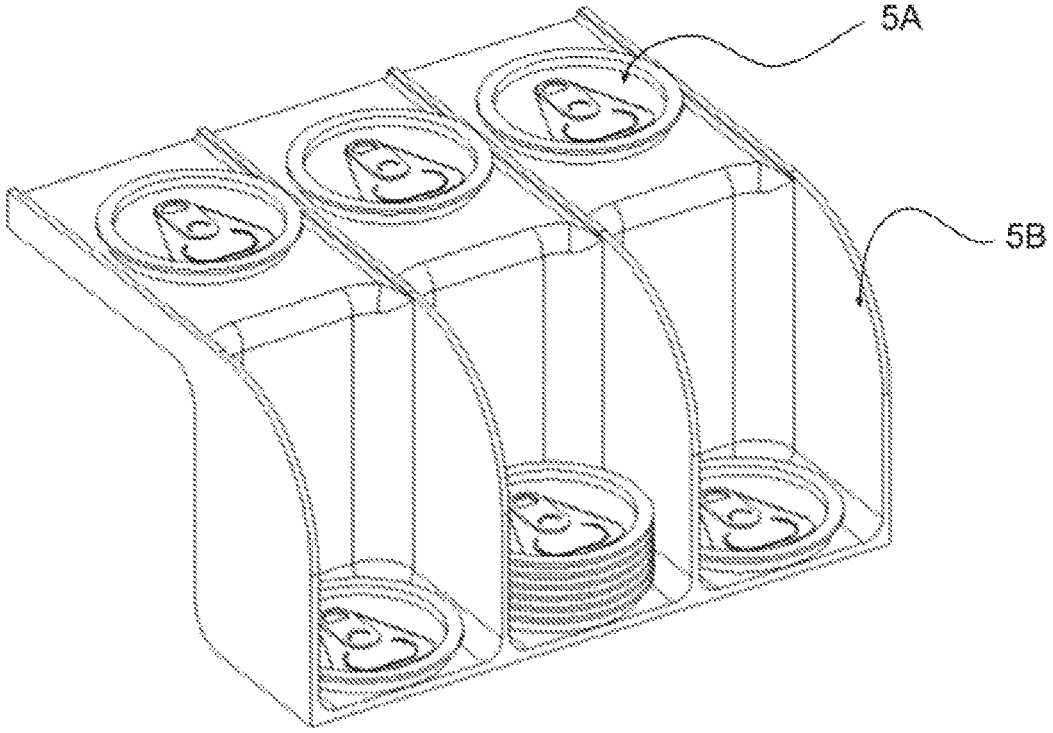
FIG. 5 illustrates an example of a Container Lid Applicator Apparatus 5B and Container Lids 5A according to various embodiments described herein.
Figure 6:
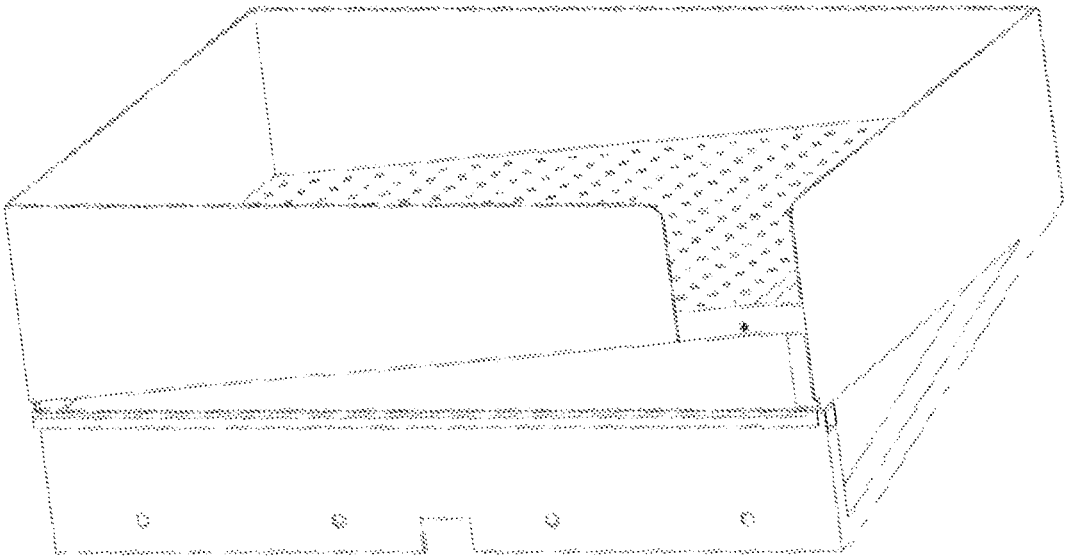
FIG. 6 illustrates an example of a Container Accumulation Assembly according to various embodiments described herein.

The second operation for this apparatus, after the Refrigeration Assembly 8 is loaded with small storage containers or hooked to a larger, external storage tank, is to load and deliver empty containers to the Conveyor Assembly 9. FIG. 2 shows an example of an Empty Container Loading Assembly 2. This Assembly 2 may include two subassemblies, the Container Loading Chute 2B, and the Integrated Container Depalletizer 2A. Beverage containers are shipped and received by beverage manufacturers on shipping pallets. The pallet of containers will have thousands of cans on each pallet. The Integrated Container Depalletizer 2A preferably works like a spatula or a pizza peel to scoop cans out of the pallet and hold them until they can be loaded into the Container Loading Chute 2B. The example Integrated Container Depalletizer 2A shown here is able to be manipulated by an individual worker and may be integrated to mate directly with the Container Loading Chute 2B. The Container Loading Chute 2B may be sloped on an angle so that gravity feeds the containers down the chute 2B onto the Conveyor Assembly 9. The small footprint of the embodiment shown in FIG. 1 allows for the easy manipulation and control of the empty containers by one person. A handheld Container Depalletizer does not currently exist in the marketplace.

Empty beverage containers require sanitization prior to fill. Traditionally containers are sprayed with a sanitizing fluid, flipped over to drain, and then filled. This process can be detrimental to certain types of beverages if the beverage is sensitive to oxygen. Water and most sanitizers have oxygen atoms, and if all the water/sanitizer is not removed from the container the excess liquid will lead to a higher dissolved oxygen concentration. In preferred embodiments, the apparatus may comprise a Sanitization Station 11 which uses a UV-C Sanitizing light for the Sanitization of the containers. The use of the UV-C light allows the overall process to be simpler and results in a better end product, eliminating the risk of oxygen exposure during sanitization, and providing a better more even sanitizing process. As the empty containers slide down the Container Loading Chute 2B, and as they enter onto the Conveyor Assembly 9, they will pass under and/or through UV-C Sanitizing light provided by the Sanitization Station 11 to be sanitized prior to fill.

In preferred embodiments, the Conveyor Assembly 9 delivers empty containers to the Fill Head Assembly 3 and then delivers them to the Seaming Assembly 4. In some embodiments, the Conveyor Assembly 9 may have two (or any number) of pneumatic or other type of actuators that control the containers movement along the conveyor. For example, the apparatus may include a first pneumatic actuator that allows the containers into the Fill Head Assembly 3 area and a second pneumatic actuator that allows the containers to enter the Seaming Assembly 4 area. The actuators are mounted on the side of the conveyor and when extended they extend out over the conveyor, stopping the containers while the conveyor continues to operate. The containers slide along the surface of the Conveyor Assembly 9. When the actuator deactuates the actuator arm is retracted and the containers are free to move along the Conveyor Assembly 9. This sequence is similar to other beverage filling apparatus in the market and general sequencing for conveyor systems. The Conveyor Assembly 9 may preferably be controlled by a DC motor vs an AC motor and uses PWM—Pulse Width Modulation control for efficient, quiet operation although other type of motors may be used. This is different than any existing fill and seamer apparatus in the market. This allows for the apparatus to be low voltage and work with a standard 120-volt 20-amp circuit and not require additional power usually not available at a small-scale manufacturer.

In preferred embodiments, a Fill Head Assembly 3 may comprise a Flow Meter 3A, a Solenoid 3B, a Carbon Dioxide Purge Tube 3C and a Beverage Fill Tube 3D. The Fill Head Assembly 3 may be actuated by a pneumatic actuator 3E or other suitable actuator. This apparatus is the only beverage fill and seam apparatus in the market to integrate a flow meter 3A at the Fill Head Assembly 3 and control the fill of the container based on flow meter 3A control. All other existing beverage fill and seam apparatus in the market are pressure controlled, time-based to control the filling of the container, and require an extra step in the process to weigh the full beverage containers after being filled and seamed in order to verify that the containers are filled to the proper volume. However, with the apparatus of the present invention volumetric filling of the container is controlled entirely by each individual flow meter 3A on each fill head assembly 3 and will fill until the calibrated threshold of beverage displaced in the container is reached. No other existing fill and seam apparatus in the market allow for individual fill head feedback and are subject to varied lengths of the fluid delivery path, restrictions and flow rates further hindering precise volumetric filling of each individual container.

The Fill Head Assembly 33 completes the fill when the flow meters 3A provide feedback that the containers are full. In preferred embodiments, the Pneumatic Actuator 3E retracts the Fill Head Assembly 3 up, and the Carbon Dioxide Purge Tube 3C covers the dispensed beverage with a layer of carbon dioxide to ensure that the beverage does not oxidize. The next step in the process may be for the operator to manually or otherwise slide the container lids onto the container via the Container Lid Applicator Apparatus 5. Existing fill and seam apparatus in the market have an automated lid applicator apparatus. The automated lid applicator apparatuses are prone to error and often require a dedicated operator to manage the application of the lid. In preferred embodiments, the apparatus of the present invention may include a simple unique Lid Applicator Apparatus 5B that stores Lids 5A and then easily allows an operator to manually slide them on the container once the container is full. This ensures that the lids 5A are adequately installed on the container, the operator can push the lid 5A down to displace the small amount of foam on top of the beverage and help to guarantee that the lid 5A will be secure as it travels further down the conveyor to the Container Seamer Assembly 4. This method for applying the lids 5A is simple and cost effective. Other seam and fill apparatus in the market have complicated lid applicator designs and then incorporate sensors and reject control subroutines that help identify when a lid is not applied correctly. These extra mechanical pieces and controls features only add to the cost and complexity of the apparatus.

Once the lids 5A are properly installed on the container the operator may press the "Seam" button on Apparatus Control Assembly 10 which sends a command to seam the container. In preferred embodiments, the cans or containers move down the Conveyor Assembly 9 until they hit a sensor. This sensor preferably triggers a pneumatic actuator to push one container horizontally, perpendicular to the Conveyor Assembly 9 and into the Container Seaming Assembly 4. The container may then be actuated vertically by another pneumatic actuator which presses the container firmly into the Seaming Chuck 4D. The container position system that was just referenced is common to many types of fill and seam apparatus in the market or in general for conveyor positioning systems for manufacturers and distributors. The apparatus of the present invention differentiates itself in that the Container Seamer Assembly 4 spins the Seaming Chuck 4D with a lower voltage DC motor which allows the operator to use this setup with any standard 120V 20 A circuit standard for all small manufacturers. The apparatus of the present invention preferably also uses PWM—Pulse Width Modulation to control the motors which are very quiet compared to other AC and DC controls. The advantage of this setup is as mentioned, low power which makes the apparatus more cost effective but also it is much quieter than all other options in the market. Additionally, the Container Seaming Assembly 4 physically seams the container via a single Pneumatic Rotary Actuator 4B that works via a rack and pinion system which allows for three position, clockwise and counterclockwise rotation. The apparatus of the present invention is the only Fill and Seam Apparatus that preferably uses one single pneumatic, rack and pinion drive rotary actuator to seam a container. This small actuator allows for the seaming Assembly 4 to be very small which allows for the overall footprint of the Apparatus that may Refrigerate Carbonated Beverages, Fills and Seals a Container; as well as it provides highly repeatable positioning for the First Operation Seaming Roll 4E and the Second Operation Seaming Roll 4F. This simplistic design of the apparatus of the present invention results in very few manufactured parts, Seaming Roll Interface Plate 4C, yet delivers highly repeatable and reliable actuation. This results in a cost savings that can be passed on to the consumer resulting in a lower cost, more competitive beverage fill and seam solution.

Once the container is properly sealed the vertical and horizontal actuators retract, allowing another container to trigger the metal sensor and start the seaming process over again. As the new container is pushed into the Container Seaming Assembly 4, the new container pushes the sealed container out of the Container Seaming Assembly 4 and into the Rinse and Dry Assembly 7. Standard facility water, attached via a hose, is attached to the Rinse and Dry Assembly 7. Water rinses any residual beverage off the container and then standard shop air is blown on the container to remove the water. As containers continue to get seamed, the containers move along the path and eventually push out into the Container Accumulation Assembly 6. The Container Accumulation Assembly 6 is unique in that it has an innovative sloped bottom or table design that will move the containers down and to the back of the table as the containers enter the Table area. The bottom of the Container Accumulation Table may be made from perforated Teflon or any other suitable material which allows any residual water to drain from the containers while providing a slick surface for the containers to slide and accumulate. The design of the Container Accumulation Assembly 6 allows for numerous finished, filled and sealed containers to be positioned in rows without any physical operator interaction. The Container Accumulation Assembly 6 conveniently organizes the finished, filled and sealed containers for follow on packaging into bulk packaging apparatus which may be external to the apparatus of the present invention.

This invention illustrated and described herein with reference to all embodiments and referenced examples, it will be apparent those of normal skill level in the art that other similar embodiments and examples may perform similar functions with similar results. All such comparable embodiments and examples are within the scope of the present invention, are regarded thereby, and are intended to be covered by the following claims.

What is claimed is:

1. A beverage manufacturing apparatus that refrigerates a carbonated beverage and fills and seals a container, said beverage manufacturing apparatus comprising:

an integrated refrigeration assembly that holds bulk beverage containers and includes an attachment to an external beverage storage tank, therefore allowing the carbonated beverage to stay cold which keeps carbon dioxide in suspension in the carbonated beverage;

an empty container loading assembly for unloading empty beverage containers from a pallet and loading said empty beverage containers into the beverage manufacturing apparatus;

an integrated container loading chute which delivers the empty beverage containers to an integrated sanitization station;

the integrated sanitization station that uses ultraviolet light to sanitize the empty beverage containers prior to fill;

an integrated conveyor assembly driven by a direct current motor providing low voltage control and automation;

an integrated three container, pneumatic fill head assembly with separate carbon dioxide and fluid fill tubes, and precise volumetric control via an integrated flow meter;

an integrated control system with simple push button operation for full automated control without a need for an external software user interface;

an integrated container lid applicator apparatus;

a sealing apparatus that uses a single pneumatic rotary actuator, the sealing apparatus providing a highly repeatable, reliable double seam sealing operation;

an integrated container rinse and dry assembly; and an integrated filled beverage container accumulation assembly.

2. The beverage manufacturing apparatus of claim 1, wherein the empty container loading assembly includes a container depalletizer configured to remove the empty beverage containers from the pallet and place the empty beverage containers onto the integrated container loading chute.

3. The beverage manufacturing apparatus of claim 2, wherein the integrated container loading chute is sloped to allow gravity to feed the empty beverage containers down the integrated container loading chute and onto the integrated conveyor assembly.

4. The beverage manufacturing apparatus of claim 1, wherein the integrated conveyor assembly includes two pneumatic actuators that control movement of the beverage containers along the integrated conveyor assembly.

5. The beverage manufacturing apparatus of claim 1, wherein the integrated flow meter is configured to indicate when a volumetric threshold is reached during filling of the beverage containers.

6. The beverage manufacturing apparatus of claim 1, further comprising a seaming chuck that is driven by another direct current motor.

7. The beverage manufacturing apparatus of claim 1, wherein the single pneumatic rotary actuator includes a rack and pinion system allowing for three position rotation.

8. The beverage manufacturing apparatus of claim 1, wherein the integrated container rinse and dry assembly is configured to rinse the beverage containers with water and dry the beverage containers with forced air.

9. The beverage manufacturing apparatus of claim 1, wherein the integrated filled beverage container accumulation assembly includes a sloped portion that moves the beverage containers after filling as the beverage containers enter the integrated filled beverage container accumulation assembly.

10. The beverage manufacturing apparatus of claim 9, wherein a bottom portion of the integrated filled beverage container accumulation assembly is perforated to allow for draining.

* * * * *